US006321796B1

(12) United States Patent
Sawada

(10) Patent No.: US 6,321,796 B1
(45) Date of Patent: Nov. 27, 2001

(54) TUCK-IN APPARATUS FOR SHUTTLELESS LOOM

(75) Inventor: Shigeharu Sawada, Kanazawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 09/597,295

(22) Filed: Jun. 20, 2000

(30) Foreign Application Priority Data

Sep. 8, 1999 (JP) ..... 11-254486

(51) Int. Cl.[7] ..... D03D 47/48
(52) U.S. Cl. ..... 139/434
(58) Field of Search ..... 139/434

(56) References Cited

U.S. PATENT DOCUMENTS 4,957,144 9/1990 Watanabe et al. .
4,957,145 * 9/1990 Verclyte et al. ..... 139/434
5,316,050 * 5/1994 Bertsch ..... 139/434

FOREIGN PATENT DOCUMENTS 725 262 C 7/1942 (DE) .
0 291 744 A 11/1988 (EP) .
0 431 484 A 6/1991 (EP) .

* cited by examiner

*Primary Examiner*—Andy Falik
(74) *Attorney, Agent, or Firm*—Smith Patent Office

(57) ABSTRACT

A tuck-in apparatus for shuttleless loom comprises a nozzle block adapted to be provided in a warp side of a cutter cutting a weft, the nozzle block is formed with a slit opening towards three sides, including a warp side, a warp feed side, and a cutter side. The nozzle block includes a drive nozzle guiding a weft end placed within the slit to a front side along the weft feed direction by air supplied through the drive nozzle and a guide nozzle folding the weft end back into a warp shedding by air supplied through the guide nozzle wherein the slit extends parallel to a warp line and a depth end of the slit is set to come near an extended line from a cloth fell.

9 Claims, 10 Drawing Sheets

TUCK-IN APPARATUS FOR SHUTTLELESS LOOM

BACKGROUND OF INVENTION

The present invention relates to a tuck-in apparatus for shuttleless loom which stably produces high quality fabric without causing an excessive tension on the weft at the time of beating.

One example of a conventional shuttleless loom having a tuck-in apparatus which forms selvage structure by folding one end of the weft back into an warp shedding is found in Unexamined Japanese Patent Application Serial No.1-174645.

In this conventional shuttleless loom, a nozzle block having a slit to retain a weft end is provided between the warp and a cutter cutting the weft. A capturing nozzle for retaining the weft end is formed in the nozzle block which extends through a depth end of the slit. Moreover, a guide nozzle is formed in the nozzle block which obliquely extends towards a warp side surface of the nozzle block (hereinafter, referred to as a warp feed side). The nozzle block is positioned in such a manner that both the capturing nozzle and the guide nozzle are positioned remote from a cloth fell to the warp feed side along a feed direction of the nozzle block. There, the weft is beaten up to the cloth fell and is cut off by a cutter, then the weft end is retained within the slit by air supplied through the capture nozzle, and is folded back into a warp shedding by air supplied through the guide nozzle, and finally woven into fabric to form a selvage structure.

However, the conventional shuttleless loom has a following problem. In the conventional shuttleless loom as described above, a depth end of a slit (hereinafter, referred to as a slit end) formed in the nozzle block which determines the position of the weft at the time of beating is positioned remote from a cloth fell to the warp feed side along the feed direction of the nozzle block. As a result, an excessive tension is generated on the weft at the time of beating thereby breaking and damaging the weft. Thus, it makes the conventional shuttleless loom difficult form a proper selvage structure and the quality of fabric becomes poor. The reason for providing the slit end on the warp feed side rather than the cloth fell along the feed direction in the conventional shuttleless loom is that the weft end is safely folded back into the warp shedding when air from the guide nozzle is ejected to a weft retained in the slit and extending from the cloth fell with a larger angle with respect to the weft.

It is an object of the present invention to produce the tuck-in apparatus for shuttleless loom which stably produces high quality fabric without causing an excessive tension on the weft at the time of beating by ejecting air from the drive nozzle to guide the weft end towards the warp feed side of the slit.

SUMMARY OF THE INVENTION

In order to meet the above object, according to an aspect of the present invention, a tuck-in apparatus for shuttleless loom comprising: a nozzle block adopted to be provided in a warp side of a cutter cutting a weft, the nozzle block is formed with a slit opening towards three sides, including a warp side, a warp feed side, and a cutter side, said nozzle block including: a drive nozzle guiding a weft end placed within the slit to a front side along the feed direction by air supplied through the drive nozzle; and a guide nozzle folding the weft end back into the warp shedding by air supplied through the guide nozzle; said slit extends parallel to a warp line and a depth end of the slit is set to come near an extended line of a cloth fell.

With the above tuck-in apparatus, there are following advantages. The proper selvage structure is formed because the weft end is safely and steadily folded back into the warp shedding by air supplied through the drive nozzle and the guide nozzle. Moreover, a high quality fabric is produced without generating the excessive tension on the weft at the time of beating because the depth end of the slit is set to come near an extended line of the cloth fell.

These and other objects, features and advantages of the invention will become more apparent upon reading the following detailed description of a preferred embodiment which is illustrated in the appended drawings.

DETAILED DESCRIPTION OF THE PREFERED EMBODIMENT OF THE INVENTION

Referring now to FIGS. 1–10, a preferred embodiment of the invention is described hereinafter. A tuck-in apparatus for a shuttleless loom shown in FIGS. 1 and 2 comprises a nozzle block 10 adopted to be provided in a warp Y1 side of a cutter CT cutting a weft. The shuttleless loom includes a weft inserting nozzle MN and a reed R. The weft inserting nozzle MN ejects a weft Y2 into a warp shedding Yo formed by the warps Y1, Y1 . . . and the reed R beats up the weft Y2, which was ejected into the warp shedding Yo by the weft inserting nozzle MN, to the cloth fell in order to produce a fabric. The weft inserting nozzle MN and the reed R are provided in an unillustrated reed holder which moves back and forth along the warp line. One pair of the cutter CT and the nozzle block 10 are provided on the weft inserting nozzle side and its opposite side. The cutter CT cuts the weft Y2 into a certain length after the weft Y2, having inserted into the opening of the warp, is beaten up to the reed.

Figure 1:
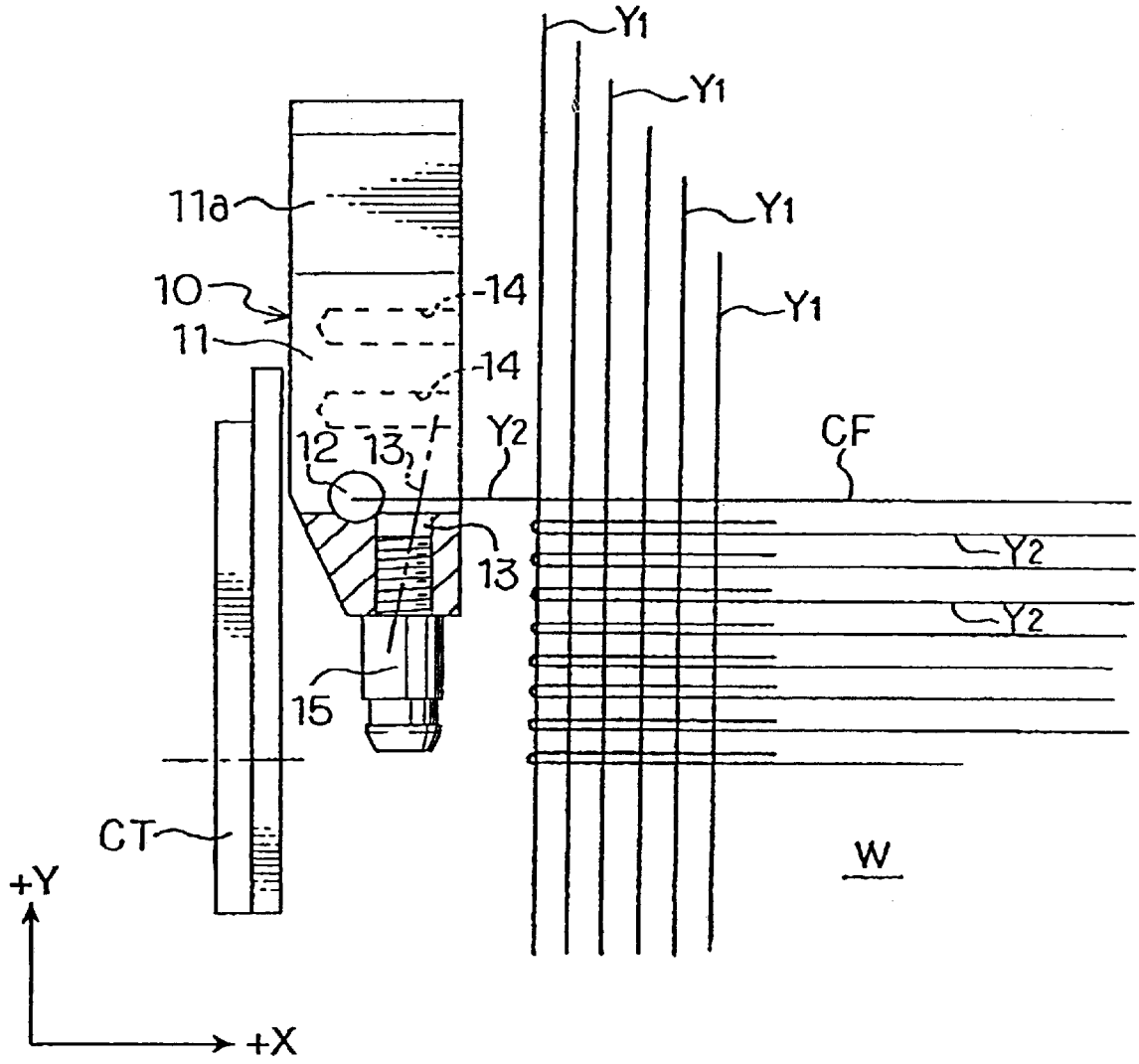
FIG. 1 is a plan view showing an overall structure of a tuck-in apparatus and peripheral devices of the present invention.
Figure 2:
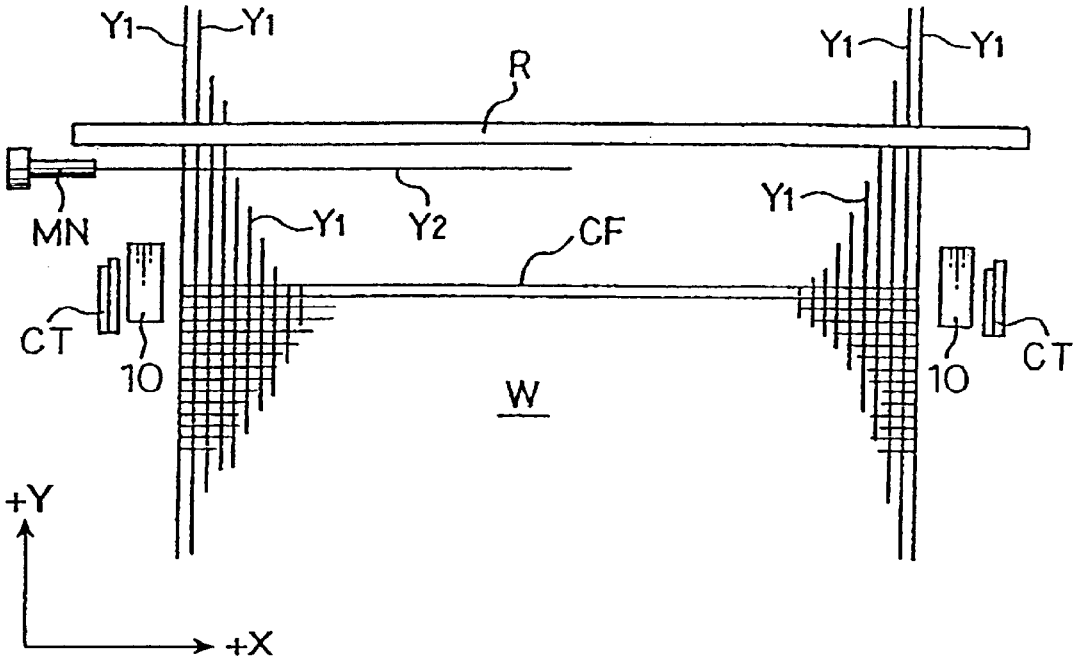
FIG. 2 is an explanatory view showing how a shuttleless loom is used.
Figure 3:
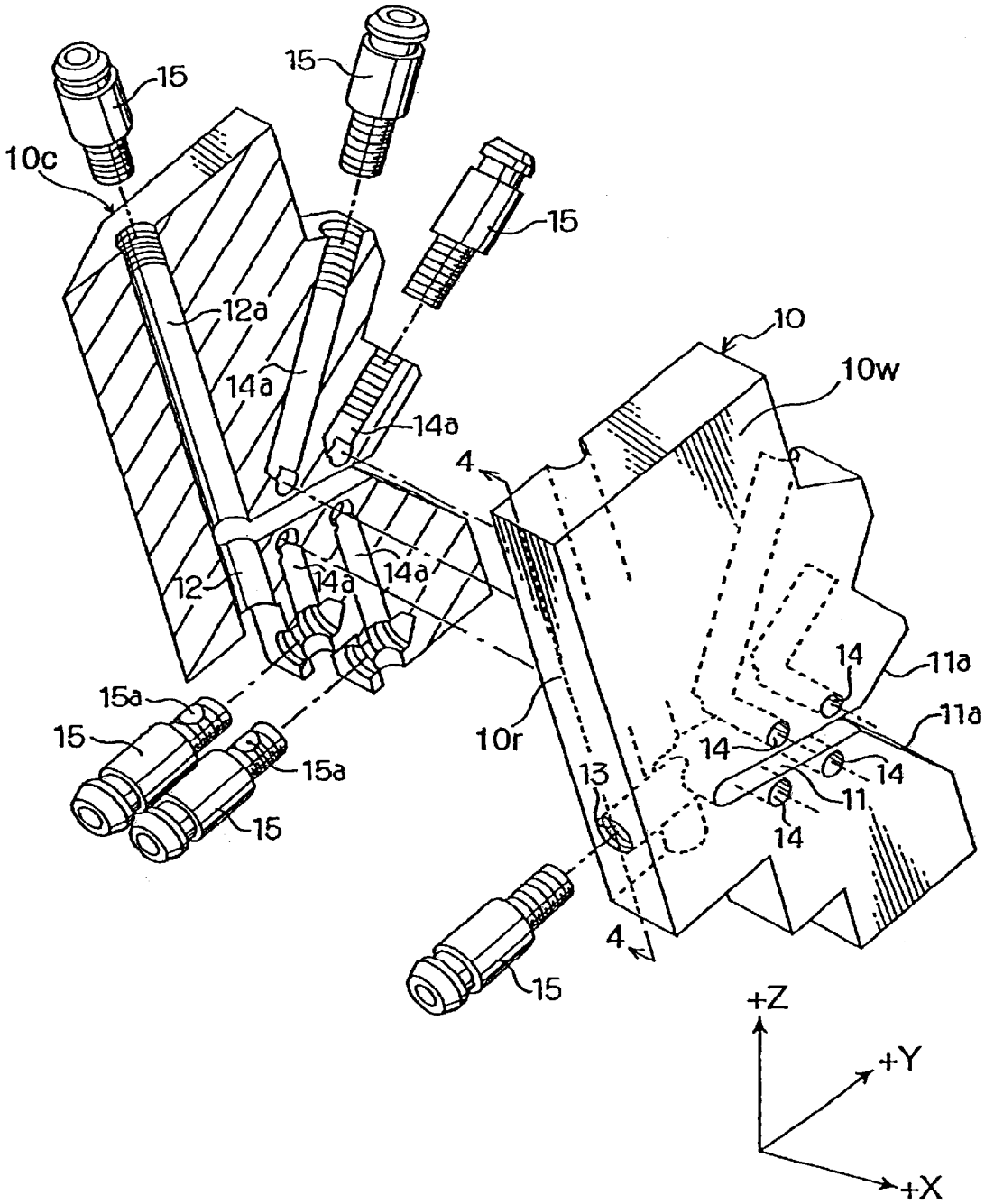
FIG. 3 is a cross-sectional and disassembled perspective view showing a construction of a nozzle block.
Figure 4:
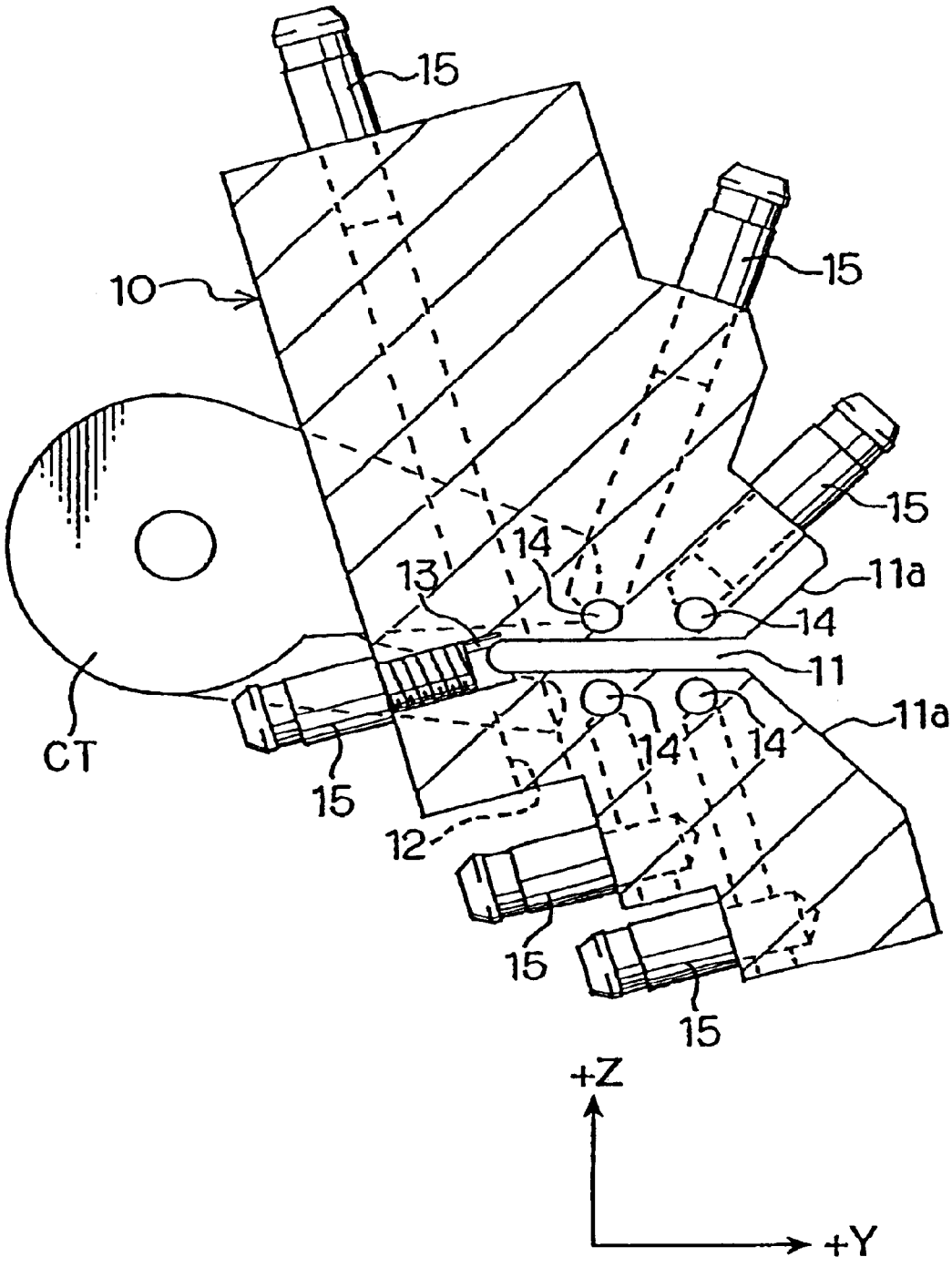
FIG. 4 is a cross-sectional view taken along line 4—4 of FIG. 3.

As shown in FIGS. 1 and 3, each nozzle block 10 is a block like thick plate having a slit 11, a capturing nozzle 12, a drive nozzle 13, and a guide nozzle 14. The slit 11 in the nozzle block 10 opens towards three sides, namely a warp side (+X), a front side (+Y) along a feed direction (hereinafter, referred to as a warp feed side), and a cutter side (−X). A guide portion 11*a* of the slit 11 is formed on the warp feed side (+Y) of the slit 11. An upper half of the guide portion 11*a* opens obliquely upward and a lower half of the guide portion 11*a* opens obliquely downward. A capturing nozzle 12 extends downwardly from the depth end of the slit in the generally vertical direction. The capturing nozzle 12 opens into an air passage 12*a* having the same diameter as the capturing nozzle 12. The air passage 12*a* extends upwardly from the depth end of the slit in the generally vertical direction. A nipple 15 is screwed into an upper end of the air passage 12*a*. Pressurized air is provided to the capturing nozzle 12 through the nipple 15 and the passage 12*a* by an unillustrated air supply source. As shown in FIGS. 3 and 4, a drive nozzle 13 extends forward to the depth end of the slit 11 from the rear surface 10*r* of the nozzle block 10 and inclines slightly downward towards the depth end of the slit. The drive nozzle 13 merges into the slit 11 at a position closer to the warp side (+X) than the capturing nozzle 12. Pressurized air is provided to the drive nozzle 13 through another nipple 15 by an unillustrated pressurized air supply source.

The drive nozzle 13 may extend obliquely towards the warp Y1 with respect to the slit 11 as indicated by one dotted chain line in FIG. 1. Guide nozzles 14 form openings on the warp side surface 10*w* of the slit 11 at positions above and below the slit 11. Each of the guide nozzles 14 extends from the warp side surface 10*w* of the nozzle block 10 towards a cutter side surface 10*c* parallel to the slit 11 and is connected to the unillustrated pressurized air supply source via an air passage 14*a* and another nipple 15. The nipples 15, used for the guide nozzles 14 positioned below the slit, are provided on the rear surface 10*r* of the nozzle block 10 and intersect with the generally vertically extending air passage 14*a*.

Figure 5:
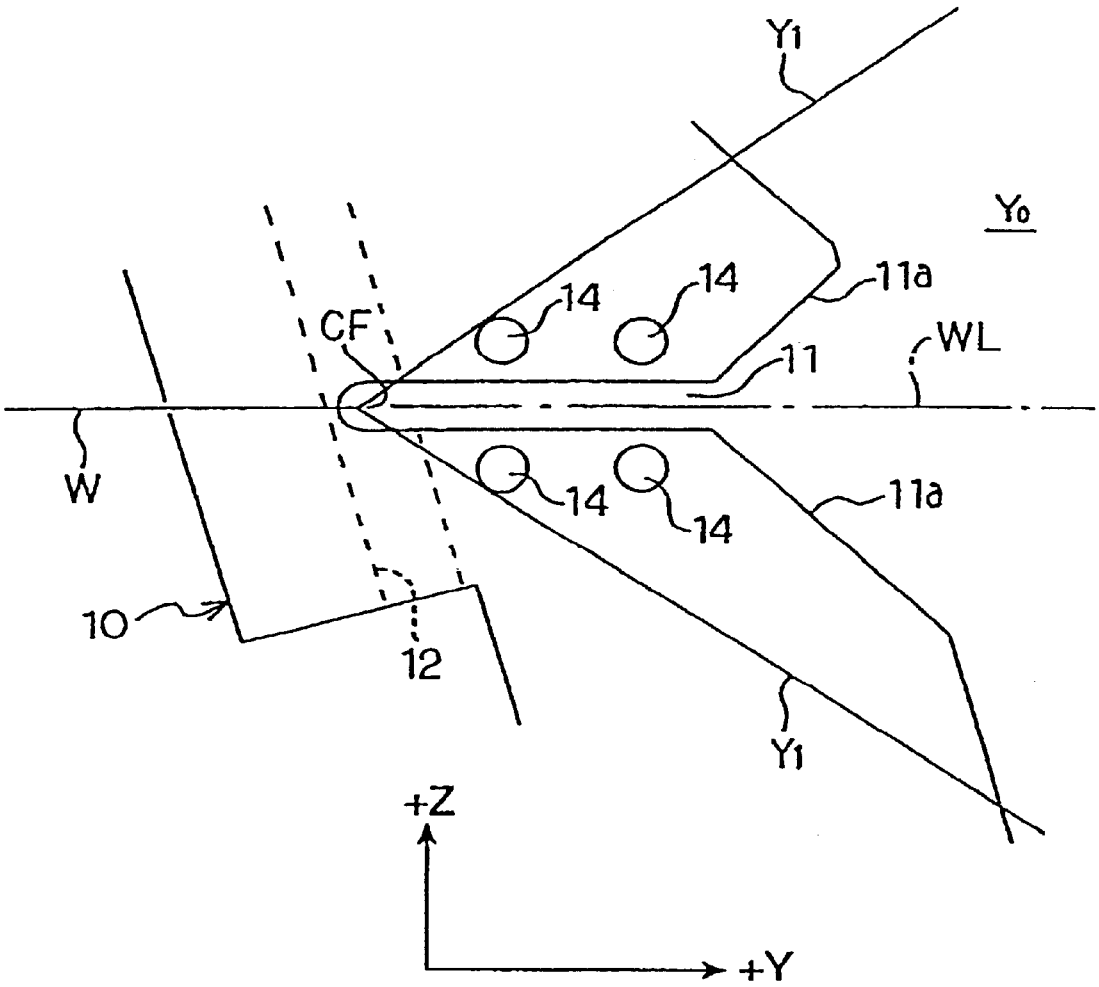
FIG. 5 is an enlarged fragmentary side view showing an essential part of the present invention.
Figure 6A:
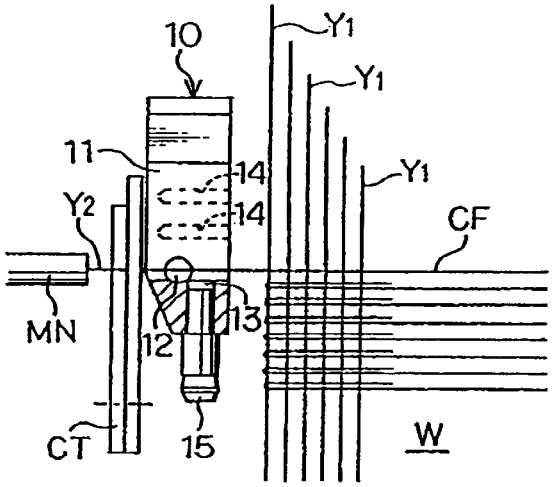
FIGS. 6A–6C are schematic views illustrating operations of the tuck-in apparatus.
Figure 6B:
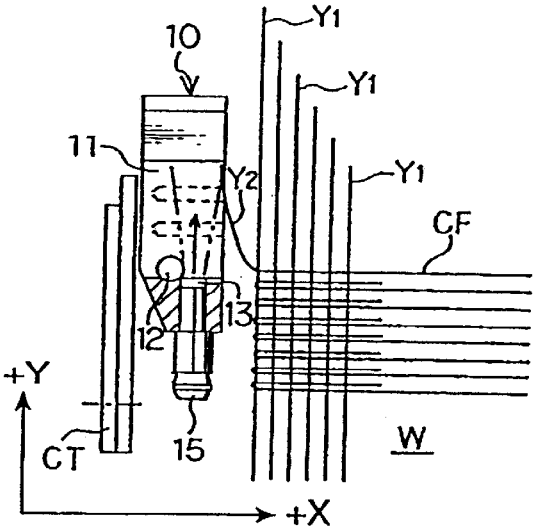
Figure 6C:
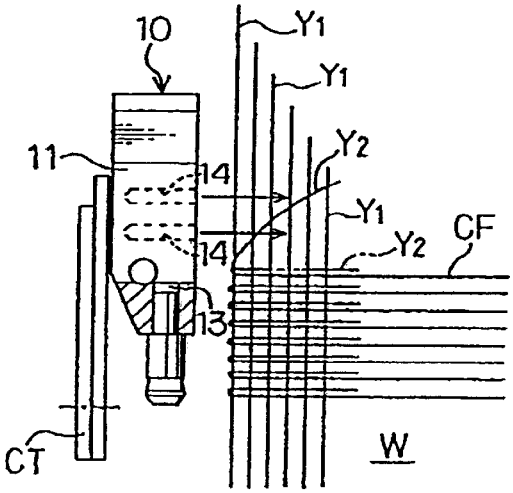

As shown in FIGS. 1 and 5, the nozzle block 10 is provided between a warp side (+X) of the cutter CT and fabric W consisting of warp Y1 and the weft Y2 in such a manner that the slit 11 of the nozzle block 10 extends parallel to the warp line WL and the capturing nozzle 12 in its top view lies substantially on an extended line of the cloth fell CF. In this instance, the guide portion 1 la of the nozzle block opens into the warp feed side (+Y), and the depth end of the slit 11 is positioned near an extended line of cloth fell CF. It is preferable that the openings of the guide nozzles 14 are positioned within the warp shedding Yo formed by the warps Y1.

A tuck-in apparatus for shuttleless loom of the present invention functions as follows. After completing the filling insertion by ejecting the weft Y2 from the weft inserting nozzle MN, the weft Y2 is beaten up to the cloth fell CF by the reed R. At the time of beating the weft Y2 is held in the place near the depth end of the slit 11 where the capturing nozzle 12 opens. The cutter CT, the depth end of the slit, and the cloth fell CF are aligned along the weft Y2. While in beating operation, the cutter CT is activated to cut the weft Y2, then air is supplied to the capturing nozzle 12 from the pressurized air supply source. Thus, the lead end of the weft Y2 on the cloth fell CF side is retained within the capturing nozzle 12 by air supplied through the capturing nozzle 12. At this time, the capturing nozzle 12 retains the weft end in an extended line of the cloth fell CF as shown in FIG. 1. Soon after closing the warp shedding Yo to retain the weft Y2 on the cloth fell CF, the air supply to the capturing nozzle 12 is stopped and air is supplied to the drive nozzle 13. The air is ejected through the drive nozzle 13 towards the warp feed side (+Y), a direction indicated by an arrow shown in FIG. 6*b*, in order to take the weft end out of the capturing nozzle 12 and to direct the weft end towards the warp feed side (+Y). As a result, the weft end of the weft Y2 constituting the cloth fell CF is curved towards the warp feed side (+Y). Then, air is supplied to the guide nozzle 14 and is ejected to the warp shedding Yo (a direction indicated by an arrow show in FIG. 6*c*). Then, the weft Y2 extended from the cloth fell CF is folded back into the warp shedding Yo (see a two dotted chain line of FIG. 6*c*). Finally, the weft folded back into the warp shedding Yo in the above manner is woven into a fabric one after another by repeatedly beating up a next weft Y2. Thus, strong selvage structure is formed (see FIG. 1).

Figure 7:
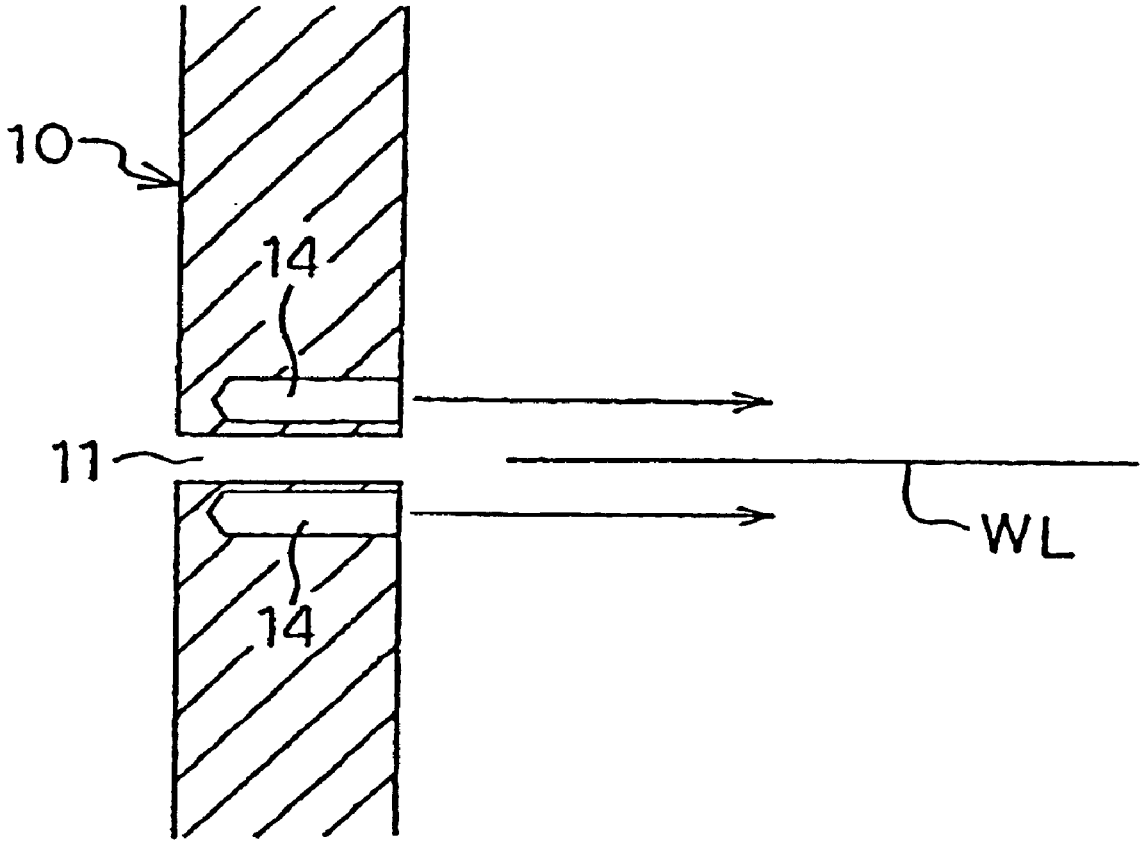
FIG. 7 is a schematic view illustrating operation of the tuck-in apparatus.

Air is ejected from the guide nozzles 14 in a direction substantially parallel to the warp line WL (see arrows shown in FIG. 7). The guide nozzles 14 are formed to extend parallel to the slit 11 and the nozzle block 10 is arranged such that the slit extends parallel to the warp line WL.

Although the nozzle block 10 provided on the weft inserting nozzle side of the fabric is described above, the same descriptions are applicable to the nozzle block 10 on the opposite side of the fabric. The nozzle block 10 on the opposite side of the fabric is also provided to retain the weft end within the slit 11 by air supplied through the capturing nozzle 12 after the weft Y2 extended from the cloth fell CF is cut off by the cutter CT and its end is folded back into the warp shedding Yo.

Figure 8A:
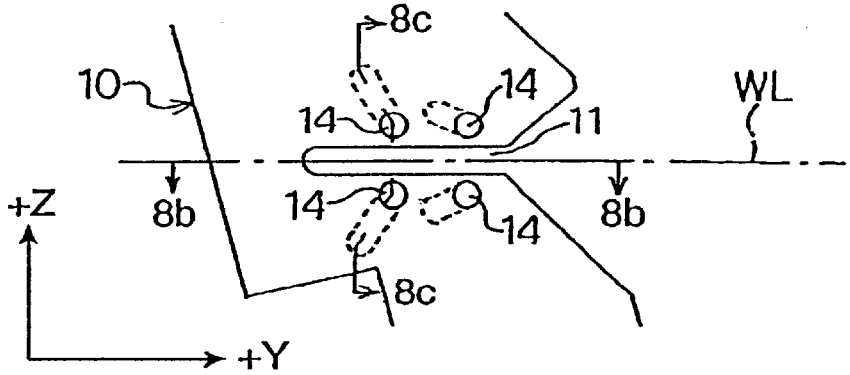
FIGS. 8A–8C are explanatory views showing an essential part of the tuck-in apparatus as a second embodiment of the present invention.
Figure 8B:
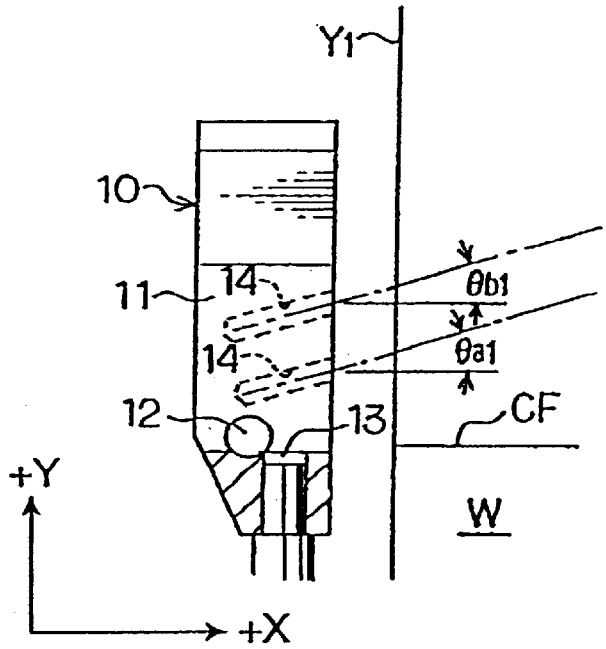
Figure 8C:
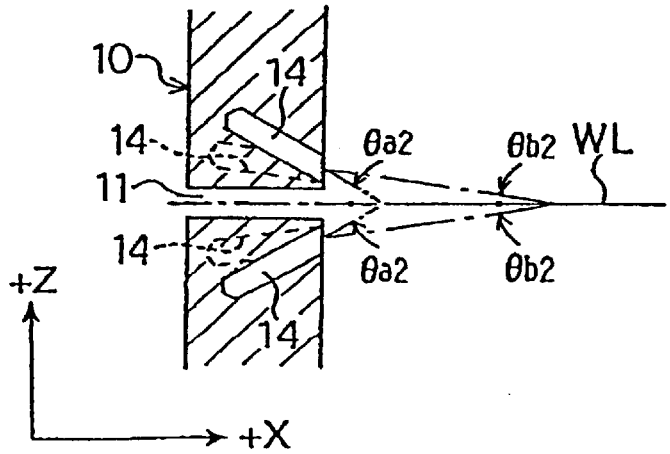

Another embodiment:

FIGS. 8A, 8B, and 8C show another embodiment of a tuck-in apparatus for a shuttleless loom. The guide nozzles 14 may extend obliquely to a front side (+Y) along a feed direction of the slit, (see FIGS. 8A and 8B). FIG. 8B is a cross-sectional view taken along a line 8*b*—8*b* of FIG. 8A. FIG. 8C is a cross-section view taken along a line 8*c*—8*c* of FIG. 8A.

A pair of the guide nozzles 14*b*1, 14*b*2 on the end opposite to the warp feed side (+Y) and another pair of the guide nozzles 14*a*1. 14*a*2 on the warp feed side (+Y) extend obliquely with respect to the cloth fell CF with angles of θa1 and θb1, respectively. It is preferable that θa1 is set substantially equal to θb1 (θa1≈θb1), however, it may be possible to set θa1 greater than θb1 (θa1>74 b1). It may also be possible to set as: θb1≠θa1=0. The guide nozzles 14 eject air to the weft end, which is blown off to the warp feed side (+Y) of the slit by air supplied through the drive nozzle 13, at almost right angle. As a result, the weft end is properly folded back into the warp shedding Yo.

The guide nozzles 14 may also be set to incline with the respect to the warp line WL as shown in FIGS. 8A and 8C. Each of the guide nozzles 14*b*1, 14*b*2 on the side closer to the depth end of the slit 11 forms an angle of θa2 with respect to the warp line WL and each of the guide nozzles 14a1, 14a2 on the warp feed side (+Y) forms an angle θb2 with respect to the warp line WL where θb2<θa2. With this configuration, the air ejected from the nozzles 14 is uniformly blown over the wide area of the warp line WL. As a result, the weft end which was folded back is not curved in on undesirable manner, enabling that the weft end is folded straight back into the warp shedding Yo. Further, the inclination angles θa2 and θb2 can be interchangeable between the nozzles 14*a*1, 14*a*2 on the warp feed side (+Y) and the nozzles 14*b*1, 4*b*2 on the depth end side.

Figure 9A:
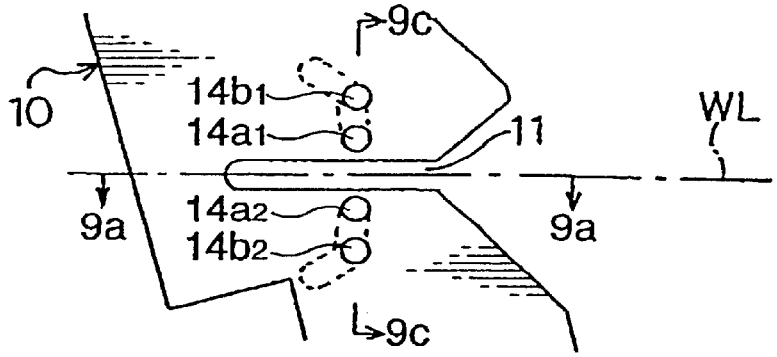
FIGS. 9A–9C are explanatory views showing an essential part of the tuck-in apparatus as a third embodiment of the present invention.
Figure 9B:
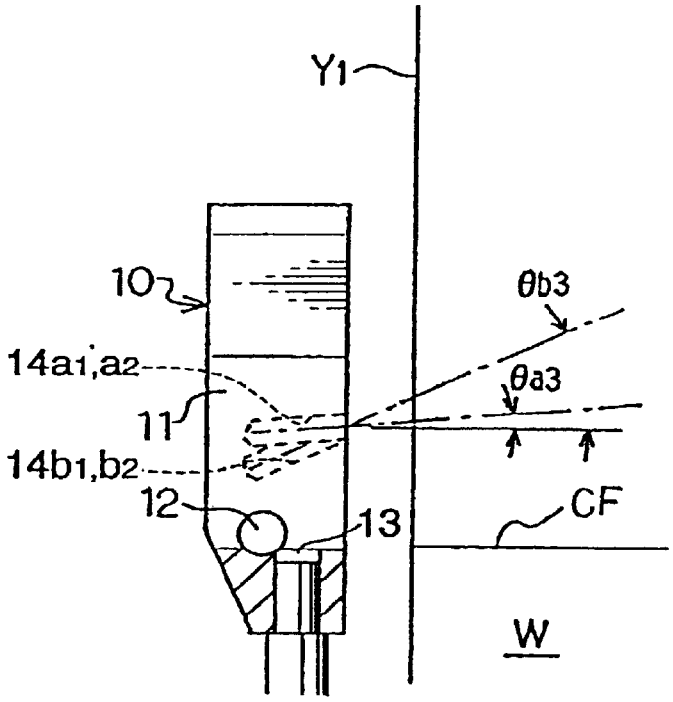
Figure 9C:
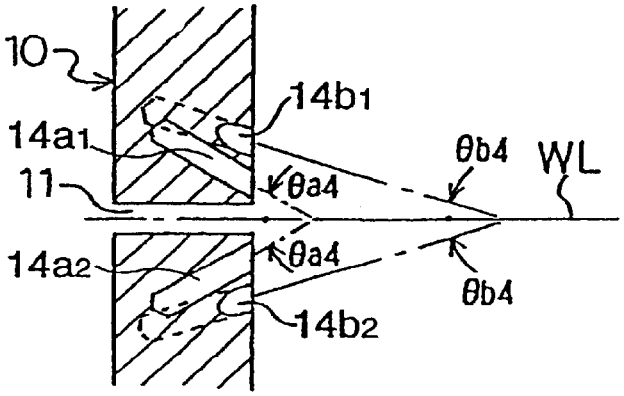

As shown in FIGS. 9A through 9C, the guide nozzles 14 can be arranged in a vertical manner, namely two are above the slit 11 and the other two are below the slit 11. FIG. 9B is a cross sectional view taken along a line 9*b*–9*b* of FIG.

9A. FIG. 9C is a cross sectional view taken along a line 9*c*—9*c* in FIG. 9A. Specially, the two nozzles 14*a*1, 14*a*2 closer to the slit 11 in the vertical direction form an angle θa3 with respect to the cloth fell CF as shown in FIG. 9B, and form an angle of θa4 with respect to warp line WL as shown in FIG. 9C. On the other hand, the other two nozzles 14*b*1, 14*b*2 remote from the slit 11 in the vertical direction form an angle 0 b3 with respect to the cloth fell CF which is greater than θa3, i.e., θb3>θa3, as shown in FIG. 9B, and form an angle 0 b4 with respect to the warp line WL which is smaller than θa4 as shown in FIG. 9C.

With the above configuration, the air can be blown over the wide range of the warp line WL so that the folding back operation of the weft end into the warp shedding Yo can be further facilitated. Moreover, the inclination angles θa3 and θb3 can be interchangeable between the nozzles 14*a*1. 14*a*2 closer to the slit 11 and the nozzles 14*b*1, 14*b*2 remote from the slit 11 in the vertical direction.

Figure 10:
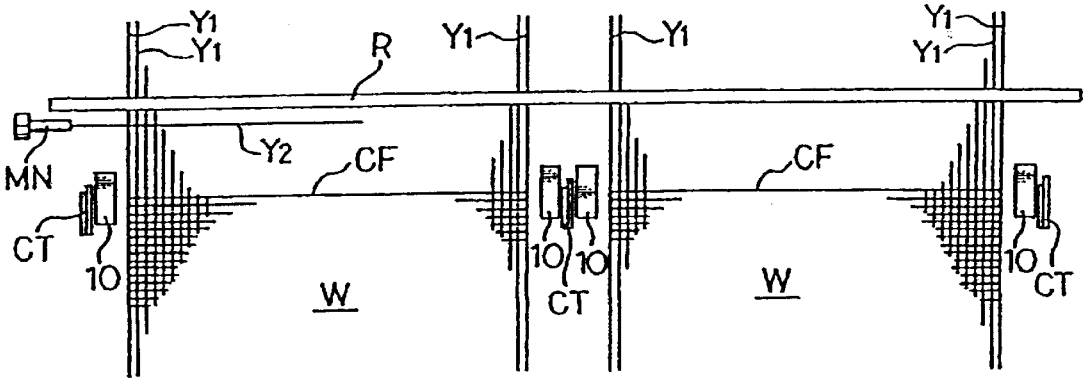
FIG. 10 is an explanatory view equivalent to FIG. 2 showing how another embodiment of a shuttleless loom is used.

As shown in FIG. 10, the nozzle block 10 can be provided on the opposite sides of each fabric W when a plurality of fabric W are simultaneously produced. In this case, the cutter CT can be shared, but not limited thereto, by the intermediate nozzle blocks 10 as shown in FIG. 10.

It may be possible that the guide nozzles 14 have respective openings all above or all below the slit 11 in the vertical direction. Alternately, it is further possible that the openings of the nozzles 14 can be arranged in symmetrical manner with respect to the slit 11. Furthermore, such openings can also be arranged in non-symmetrical manner with respect to the slit 11. Moreover, the capturing nozzle 12 can be of an air ejecting jet type as described in the above but not limited thereto. The capturing nozzle 12 can also be an air-suction type using the negatively pressured air supplied by a negative suction air source. Furthermore, the capturing nozzle 12 is required to capture the weft end, however. the way capturing the weft end con be of various types such as an air driven type as described in the above or a mechanical type which mechanically retains the weft end. If the latter type is used, such mechanical type capturing nozzle can be internally provided in the nozzle block 10 or externally provided on the nozzle block 10.

Moreover, the capturing unit can be omitted by adjusting the weft end cutting timing. Specially, if the time period between the weft end is cut and the weft end is folded back into the warp shedding is long enough, then the weft end is retained in the capturing unit. However, by reducing this time period, it becomes possible to omit the capturing unit. In this case, the weft Y2 is maintained uncut until immediately before the weft end is folded back into the warp shedding Yo.

Summing up the invention as described above along with the drawings, this invention is directed to a tuck-in apparatus for shuttleless loom comprising: a nozzle block adapted to be provided in a warp side of a cutter cutting a weft, the nozzle block is formed with a slit opening towards three sides, including a warp side, a warp feed side, and a cutter side, said nozzle block including: a drive nozzle guiding a weft end placed within the slit to the warp feed side by air supplied through the drive nozzle; and a guide nozzle folding the weft end back into the warp shedding by air supplied through the guide nozzle; said slit extends parallel to a warp line and a depth end of the slit is set to come near an extended line of a cloth fell.

In the nozzle block a capturing unit is provided to retain the weft end within the slit. The capturing unit may include a capturing nozzle for retaining the weft end within the slit by air supplied through the capturing nozzle. It is preferable that the drive nozzle extends through the depth end of the slit and merges into the slit at a position closer to the warp side than the capturing nozzle. However, the drive nozzle may extend towards the front side of the slit and may obliquely extend towards the warp side with respect to the slit.

The guide nozzle forms an opening on the warp side surface of the nozzle block and the opening is positioned at least one of above or below with respect to slit. The guide nozzle may extend obliquely towards the warp line or towards the warp feed side.

According to an aspect of the present invention, an excessive tension on the weft is not likely to be generated at the time of beating because a slit end formed in the nozzle block extends near an extended line of the cloth fell. On the other hand, the drive nozzle draws a weft end within the slit to the warp feed side by air supplied through it, and the guide nozzle folds the weft end back into the warp shedding by air supplied through it. Therefore, the weft end is steadily folded back into the warp shedding by air supplied through the guide nozzle and the proper selvage structure is formed by a following opening motion and a beating motion. The depth end of the slit is positioned near an extended line of the cloth fell. Where, the position near the extended line of the cloth fell means a range near the cloth fell where an excessive tension on the warp is not generated at the time of beating. It is preferable for the slit to be formed substantially parallel to the warp line in the nozzle block.

When a capturing unit is provided for the tuck-in apparatus, it functions as follows. As soon as the weft extending from the cloth fell to the cutter through the slit is cut by the cutter, a weft end is retained within the nozzle block by the capturing unit. Thus, the weft is steadily positioned in a certain place of the nozzle block by the capturing unit. Various types including a mechanical type and air driven type can be used as the capturing unit as long as it can determine the position of the weft near the slit end. Either an air ejecting jet type using the pressurized air or an air-suction type using the negatively pressured air can be used when the air driven type is selected as the capturing unit.

The drive nozzle extends through the depth end of the slit and merges into the slit at a position closer to the warp side than the capturing nozzle. Therefore, the weft end is easily taken out from the capturing nozzle and steadily retained in the drive nozzle by blowing air to the weft captured by the capturing nozzle in the nozzle block.

As the drive nozzle is so formed that it extends forward to the depth end of the slit from the rear surface of the nozzle block, the weft end is blown out to the warp feed side by air ejected through it. In addition, the weft end within the slit is obliquely blown out to the warp side of the nozzle block by air ejected through it by forming the drive nozzle to extend obliquely toward the warp side with respect to the slit. As a result, it helps the folding back motion of the weft into the warp shedding by the guide nozzle.

Guide nozzles forming openings to the warp side surface of the slit are positioned closer to the warp side than the drive nozzle. Therefore, the weft end is steadily folded back into the warp shedding by air ejected through drive nozzles. Guide nozzles may form openings on the warp side surface of the nozzle block and openings may be positioned either above or below with respect to the slit. The openings may also be positioned both above and below with respect to the slit. Guide nozzles may also form at least one opening positioned either above or below with respect to the slit on the warp side surface of the nozzle block.

As guide nozzles are so formed that they have oblique upward or downward openings with respect to the warp line, the weft end is property folded straight back into the warp shedding. Air can be effectively blown over the wide range of the warp which is being folded back into the warp shedding by providing plurality of guide nozzles having openings with different inclination angles toward the warp line.

Guide nozzles having oblique openings toward the warp feed side eject air to the weft extending from the cloth fell at substantially right angles when the weft end is folded back into the warp shedding. As the result, the weft end is folded back into the warp shedding properly and it prevents the selvage structure from loosening. Plurality of guide nozzles may be formed in the n6zzle block and all or a part of them may form oblique openings to a front side of the slit along a feed direction, that is a warp feed side.

This application is based on patent application No. 11-254486 filed in Japan on Sep. 8, 1999, the contents of which are hereby incorporated by.

As this invention may be embodied in several forms without departing from the sprit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A tuck-in apparatus for shuttleless loom comprising:

a nozzle block adapted to be provided in a warp side of a cutter cutting a weft, the nozzle block is formed with a slit opening towards three sides, including a warp side, a warp feed side, and a cutter side, said nozzle block including:

a drive nozzle guiding a weft end placed within the slit to the warp feed side by air supplied through the drive nozzle; and a guide nozzle folding the weft end back into a warp shedding by air supplied through the guide nozzle;

said slit extends parallel to a warp line and a depth end of the slit is set to come near an extended line from a cloth fell.

2. The tuck-in apparatus according to claim 1, wherein the nozzle block has a capturing unit for retaining the weft end within the slit.

3. The tuck-in apparatus according to claim 2, wherein the capturing unit includes a capturing nozzle for retaining the weft end within the slit by air.

4. The tuck-in apparatus according to claim 3, wherein the drive nozzle extends through the depth end of the slit and merges into the slit at a position closer to the warp side than the capturing nozzle.

5. The tuck-in apparatus according to claim 1, wherein the drive nozzle extends towards a front side of the slit.

6. The tuck-in apparatus according to claim 1, wherein the drive nozzle obliquely extends towards the warp side with respect to the slit.

7. The tuck-in apparatus according to claim 1, wherein the guide nozzle forms an opening on the warp side surface of the nozzle block and the opening is positioned at least one of above or below with respect to the slit.

8. The tuck-in apparatus according to claim 7, wherein the guide nozzle extends obliquely towards the warp line.

9. The tuck-in apparatus according to claim 1, wherein the guide nozzle obliquely extends towards the warp feed side.

* * * * *